United States Patent [19]

Tanaka et al.

[11] Patent Number: 4,519,649

[45] Date of Patent: May 28, 1985

[54] WHEELCHAIR

[75] Inventors: Osamu Tanaka, Sagamihara; Hiroshi Iijima, Isehara; Masayoshi Ito, Atsugi; Etsumi Okigawa, Hadano, all of Japan

[73] Assignee: Kanagawa Rehabilitation Center, Kanagawa, Japan

[21] Appl. No.: 479,369

[22] Filed: Mar. 28, 1983

[30] Foreign Application Priority Data

Mar. 26, 1982 [JP] Japan ..... 57-47291

[51] Int. Cl.[3] ..... A47C 1/02

[52] U.S. Cl. ..... 297/316; 297/DIG. 4; 297/DIG. 10

[58] Field of Search ..... 297/DIG. 4, DIG. 10, 297/345, 316

[56] References Cited

U.S. PATENT DOCUMENTS

| | | | |
|---|---|---|---|
| 3,406,772 | 10/1968 | Ahrent et al. | 297/DIG. 10 |
| 3,640,566 | 2/1972 | Hodge | 297/DIG. 10 |
| 3,837,704 | 9/1974 | Bauer | 297/345 |
| 3,964,786 | 6/1976 | Mashuda | 297/DIG. 10 |
| 4,067,249 | 1/1978 | Deucher | 297/DIG. 10 |
| 4,076,304 | 2/1978 | Deucher | 297/DIG. 10 |
| 4,407,543 | 10/1983 | Mashuda | 297/DIG. 10 |

FOREIGN PATENT DOCUMENTS

| | | | |
|---|---|---|---|
| 494034 | 1/1978 | Australia | 297/DIG. 10 |
| 2625046 | 12/1977 | Fed. Rep. of Germany | 297/DIG. 10 |
| 1276255 | 6/1972 | United Kingdom | 297/DIG. 10 |

*Primary Examiner*—James T. McCall

*Attorney, Agent, or Firm*—Armstrong, Nikaido, Marmelstein & Kubovcik

[57] ABSTRACT

A wheelchair is disclosed in which a body support frame pivoted to a main frame can move from a seated posture to a stand-up posture and vice versa without using an external elevating force. The wheelchair includes the main frame for supporting driving wheels and auxiliary wheels and a body support frame formed by interconnecting a lower limb support member, a waist support member and a back rest member to one another. The forward portion of the main frame and the tip portion of the waist support member are turnably supported by a pivot, and an extension member for turnably supporting the waist support member with the pivot as the support point is interposed between the main frame and the waist support member. The motive force for the stand-up operation of the body support frame relies upon the push-up force of the user of the wheelchair (the body lift-up force of the user by his or her upper limbs) and the force of the extension member.

5 Claims, 4 Drawing Figures

WHEELCHAIR

BACKGROUND

This invention relates to a wheelchair which makes it possible for the handicapped with an extremely limited or no lower-limb function such as a paraplegic to change his or her posture from a seated posture to a stand-up posture and vice versa, using his or her push-up force (the body lift-up action of the handicapped by his or her upper limb) which he or she daily exercises, as the motive force, without using any external power.

The wheelchair is a kind of vehicle which is required to cover a range of motion substantially the same as walking and can be regarded as a short-distance transportation vehicle. Accordingly, the wheelchair must have a full function as a daily instrument, a moving function and a function which makes it possible for the handicapped to carry out work by use of the wheelchair. However, in accordance with the conventional wheelchair, the user of the wheelchair can do the work only in the seated posture but cannot do work which can be done only in a stand-up posture because his or her hands cannot reach a high position.

Wheelchairs using an external power source (such as motor drive using a battery as the power source) for a stand-up mechanism have been proposed in recent years for a wheelchair which enables the user to do a work in a stand-up posture. However, the wheelchairs of this kind involve the drawbacks that the charging work and maintenance are complicated, that the weight of the wheelchair increases and that the wheelchair itself is extremely expensive with limited versatility.

SUMMARY

It is therefore an object of the present invention to provide a wheelchair which eliminates the problems with the prior art and which has a novel construction.

It is another object of the present invention to provide a wheelchair which is economical and simple in construction and does not use an external power source for the stand-up mechanism.

To accomplish these objects, the wheelchair in accordance with the present invention includes a main frame for supporting driving wheels and auxiliary wheels and a body support frame formed by interconnecting a lower limb support member, a waist support member and a back rest member to one another, wherein the forward portion of the main frame and the tip portion of the waist support member are turnably supported by a pivot and an extension member for turnably supporting the waist support member with the pivot as the support point is interposed between the main frame and the waist support member.

According to the construction described above, the body support frame turnably fitted to the main frame can be easily moved from a seated posture to a stand-up posture and vice versa by a push-up force exerted by the user of the wheelchair and the force of the extension member, without using any external power source.

In a preferred embodiment of the present invention, the waist support member and the back rest member, and the waist support member and the lower limb support member are interconnected respectively to the main frame by link mechanisms, and the link for the waist support member and the back rest member consists of a parallelogrammic 4-rod link while the link for the waist support member and the lower limb support member consists of a 4-rod link having any desired length.

According to this construction, the angle of the back rest member with respect to the horizontal can be always kept at a predetermined value during the stand-up operation while the portion of the lower limb support member can be gradually extended with respect to the portion of the waist support member so as to correspond to the stretch of the portion of the body below the knees with the stretch of the knee joints of the user during the stand-up operation.

The present invention will become more apparent from the following description of a preferred embodiment thereof taken in conjunction with the accompanying drawings.

DRAWINGS

PREFERRED EMBODIMENT

Figure 1:
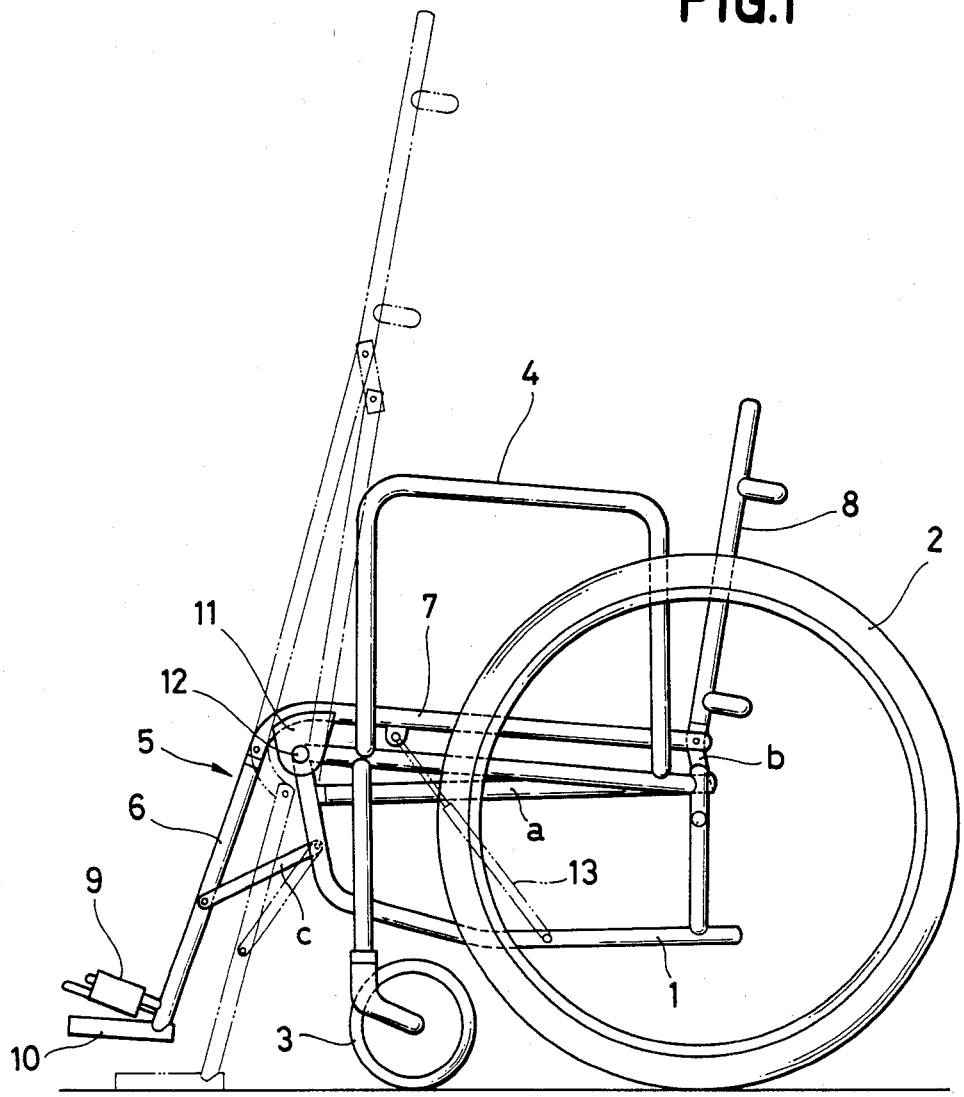
FIG. 1 is a side view showing the wheelchair in accordance with one embodiment of the present invention.
Figure 2:
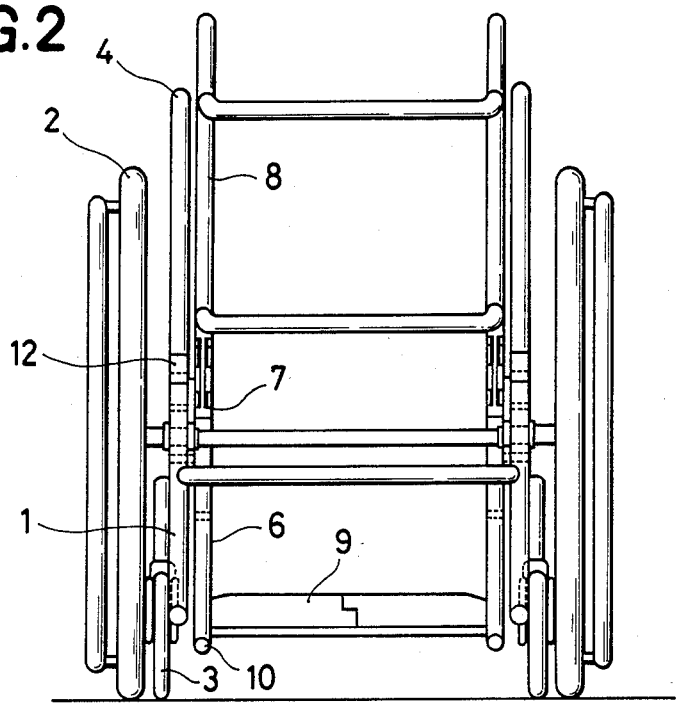
FIG. 2 is a rear view of FIG. 1.

In FIGS. 1 and 2, the reference numeral 1 represents a main frame which supports driving wheels 2 and auxiliary wheels 3. An elbow support 4 is fixed to the upper part of the main frame 1 on each side. Reference numeral 5 represents a body support frame which consists of a lower limb support member 6, a waist support member 7 and a back rest member 8. These members are connected in such a manner that the adjacent members are turnable relative to each other. A foot plate 9 and a landing member 10 are fixed to the lower end of the lower limb support member 6. The tip of the waist support member 7 is bent in an arcuate form and a bracket 11 is fixed to the arcuate portion and is turnably fitted to the forward portion of the main frame 1 by a pivot 12. The stand-up mechanism of the body support frame 5 consists of the back rest member 8, the waist support member 7 and the lower limb support member 6 which are connected to one another by two 4-rod links. Among these links, the link for the back rest member 8 and the waist support member 7 is a parallelogrammic 4-rod link connecting the links a and b to the pivot 12, and the link for the waist support member 7 and the lower limb support member 6 is a 4-rod link which connects the joint between the both members 6, 7 and the link c to the pivot 12 and may have an arbitrary or optional length. These two link mechanisms are fitted to the main frame 1.

Figure 3:
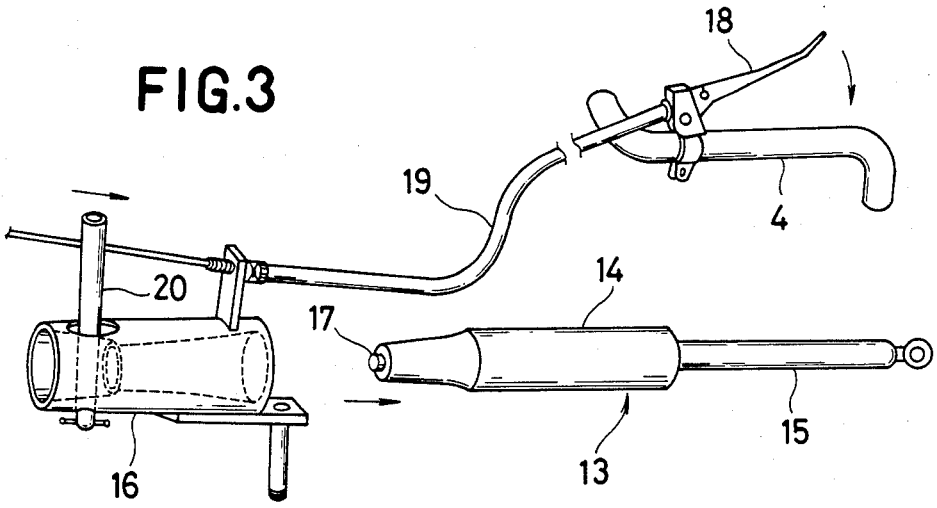
FIG. 3 is a perspective view showing the state in which a gas spring as an extension member is used.

A gas spring 13 as an extension member is interposed between the main frame 1 and the waist support member 7 so that the retracting motion of the spring 13 supports and can raise up and down the waist support member 7 with the pivot 12 as the support point. This gas spring is a kind of spring which utilizes the pressure of a high pressure gas sealed in a cylinder 14 as shown in FIG. 3 so that a piston and a rod 15 connected to the piston inside the cylinder are actuated and are stopped at an arbitrary position. A gas spring receiver 16 is fitted to the main frame 1 while the rod 15 is fitted to the waist support member 7. A valve operation button 17 (hereinafter referred to as a "lock button") can be operated by remote-controlling an operation lever 18 which is fitted to the elbow support member 4. In the drawings, the reference numeral 19 represents an operation wire, and 20, a valve operation lever.

When the operation lever 18 is gripped, the valve operation lever 20 and the valve operation button 17 are actuated in the direction indicated by an arrow and release the lock of the gas spring 13. When the grip of the operation lever 18 is released, on the other hand, the valve operation lever 20 and the valve operation button 17 are actuated in the reverse direction whereby the gas spring 13 is locked.

The motive force of the stand-up of the wheelchair in this embodiment relies upon the push-up force of the user of the wheelchair (the force of pushing up the body by the user's upper limbs) and the reaction of the gas spring. The user can take the stand-up posture by use of these two kinds of force. The mode of use is as follows.

To stand up, the wheelchair may first be braked, and the knees and waist of user's body may then be fixed firmly to the wheelchair by a belt. After this preparation is completed, the operation lever 18 fitted to the elbow support 4 may be gripped and the lock button 17 of the gas spring is depressed so as to release the lock of the gas spring. In the stage where the lock is released, the gas spring starts operating. In this instance, the user puts his or her hand upon the elbow support 4 and then pushes up to reduce his or her weight acting upon the seat so that the rod 15 of the gas spring extends due to the gas reaction and the seat of the wheelchair starts elevating. During stand-up, the user releases the grip of the operation lever 18 at a desired height so as to eliminate the push force of the lock button 17 and to lock the gas spring. The seat can thus be fixed at that position.

To return to the seated posture from the stand-up posture, first the lock of the gas spring may be released by the operation lever 18 and the user may then lower his or her body while gripping the elbow support 4 so as to apply his or her weight to the seat. In this instance, the weight of the user overcomes the gas reaction and the rod of the gas spring contracts so that the seat starts lowering slowly. In this case, too, the user can fix the seat at a desired position by locking the gas spring.

In the embodiment described above, the maximum angle of stand-up of the waist support member is 75 degrees relative to the horizontal but the angle can be easily set to any value desired by the user. The angle of the back rest member 8 during stand-up can be always kept constant with respect to the horizontal by the parallelogrammic 4-rod link for the back rest member 8 and waist support member 7. The portion of the lower limb support member 6 can extend gradually with respect to the waist support member 7 so that it can correspond to the extension of the portion of the user below his or her knees with the extension of his or her knee joint during stand-up. This extension is attained because the link for the waist support member 7 and the lower limb support member 6 is constructed by the 4-rod link having an arbitrary length. In the embodiment described above, the quantity of extension is 50 mm with respect to the maximum stand-up but the value can be properly adjusted in accordance with the user's desire. Push-up during stand-up is necessary until the waist support member 7 becomes 30° relative to the horizontal but when it exceeds 30°, stand-up can be accomplished only by the force of the gas spring. Various other adjustments can be made in accordance with the weight of the user by appropriately adjusting the reaction of the gas spring and moreover, the gas spring can be replaced easily.

Figure 4:
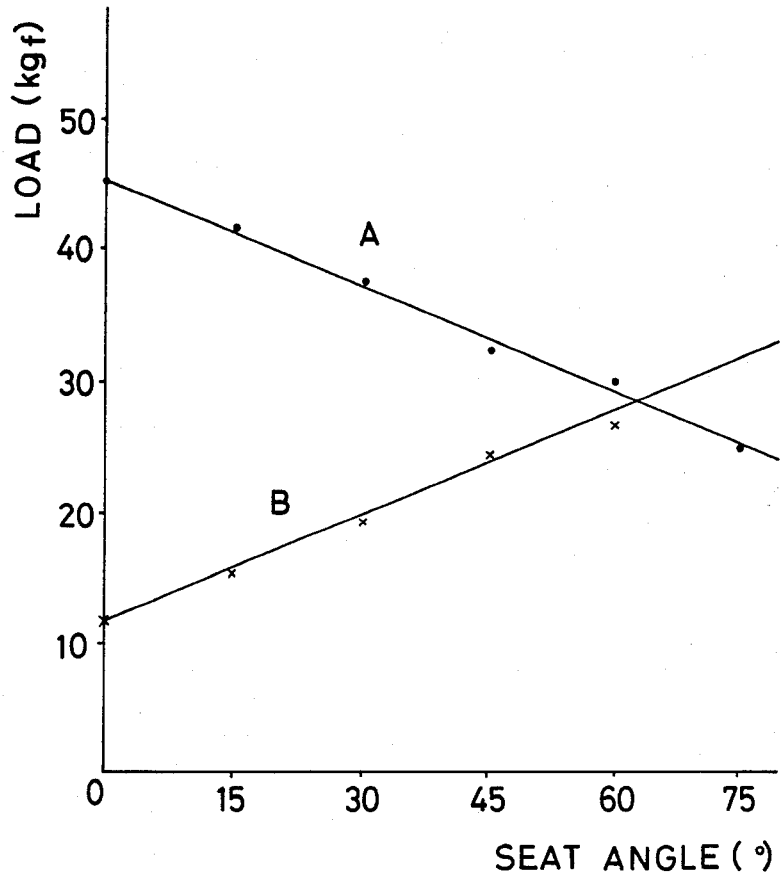
FIG. 4 is a diagram showing the relation between the seat angle (stand-up angle) and the load applied to the seat and to the foot plate.

FIG. 4 is a diagram showing the relation between the seat angle (the stand-up angle of the waist support member 7) and the load A applied to the seat and between the seat angle and the load B applied to the foot plate 9. The abscissa represents the seat angle (degrees) and the ordinate the load (kgf). As is obvious from the diagram, the weight of the user is primarily borne by the seat when the angle is small and is borne by the foot plate and the seat when the angle is great. Accordingly, the user can keep the seated posture or the stand-up posture without the need of exerting an excessive force. Moreover, since a part of the weight is borne by the seat even at the time of the maximum stand-up, the user can rest against the back and smoothly carry out work in the stand-up posture.

Although the foot plate 9 and the landing member 10 are fixed to the lower end of the lower limb support member 6 in the foregoing embodiment, the user can move the wheelchair while keeping the stand-up posture if small wheels are further fitted. The driving wheel may also be of an electric type with its operation switch being fitted to the elbow support member for easy operation of the wheelchair. Although the wheelchair of the foregoing embodiment is not foldable, it can be changed to a foldable type by incorporating a folding mechanism.

In accordance with the present invention, the body support frame consists of the lower limb support member, the waist support member and the back rest member 8 and is actuated by the ingenious combination of the extension member with the link mechanisms. Accordingly, the user of the wheelchair can easily change from a seated position to a stand-up position and vice versa. Even when the user assumes a stand-up posture, he or she can support his or her body by the body support frame so that he or she can smoothly carry out a work in the stand-up posture. Since the user can take and keep the stand-up posture, decubitus and contracture of the joints of the handicapped with a minimal or no lower-limb function can be prevented. The use of the gas spring as the extension member makes it possible to continuously and smoothly change the body support frame from the seated posture to the stand-up posture and vice versa. The seat can be set and fixed at a desired position even during the shift of the posture without any difficulty to the user. Moreover, since the shift from the seated posture to the stand-up posture and vice versa can all be effected manually, the wheelchair of the present invention is easy to operate and can eliminate otherwise likely dangers to the user and complicated maintenance procedures.

What is claimed is:

1. A wheelchair comprising:

a main frame supporting driving wheels and auxiliary wheels;

a body support frame including pivotally interconnected lower limb support member, waist support member and backrest member, said main frame and said body support frame being formed as independent structures, a front end portion of said waist support member of said body support frame being pivotally connected to a front end portion of said main frame by pivot means;

a pair of elbow supports each fixed to an upper portion of said main frame at respective sides thereof, said waist support member of said body support frame being disposed between said pair of elbow supports in a seating position of said body support frame;

a gas spring fitted, at one end thereof, to a gas spring receiver pivotally connected to said main frame, and pivotally connected at its other end by a piston rod thereof to said waist support member of said body support frame such that extension and retraction of said gas spring causes said waist support member to rotate about said pivot means with respect to said main frame; and locking means in operable connection with said gas spring for locking said gas spring in an arbitrary position between a fully extended and a fully retracted position so as to fix said waist support member at an arbitrary angle with respect to the horizontal within a prescribed angular range of its rotation about said pivot means, said fully extending and fully retracted positions of said gas spring corresponding to seating and standing positions of said body support frame, respectively.

2. A wheelchair as defined in claim 1, wherein said locking means comprises a valve operation lever carried by said gas spring receiver for operating a valve of said gas spring, an operation lever mounted on one of said pair of elbow supports, and an operation wire operably connecting said valve operation lever and said operation lever, whereby gripping of said operation lever operates said valve thereby permitting extension and retraction of said gas spring whereas releasing said operation lever causes locking of said gas spring so as to prevent the extension or retraction thereof.

3. The wheelchair as defined in claim 1, wherein said waist support member and said back rest member, and said waist support member and said lower limb support member are connected to said main frame by link mechanisms, respectively.

4. The wheelchair as defined in claim 3, wherein said link mechanism for said waist support member and said back rest member consists of a parallelogrammic 4-rod link mechanism.

5. The wheelchair as defined in claim 3, wherein said link mechanism for said waist support member and said lower limb support member consists of a 4-rod link mechanism having an arbitrary length.

* * * * *